US006063747A

United States Patent [19]

Warwick

[11] Patent Number: 6,063,747

[45] Date of Patent: May 16, 2000

[54] DETERGENT COMPOSITIONS IN COMPACTED SOLID FORM

[75] Inventor: Jane Margaret Warwick, Newcastle upon Tyne, United Kingdom

[73] Assignee: The Procter & Gamble Company, Cincinnati, Ohio

[21] Appl. No.: 09/000,282

[22] PCT Filed: Jul. 12, 1996

[86] PCT No.: PCT/US96/11582

§ 371 Date: Jul. 31, 1998

§ 102(e) Date: Jul. 31, 1998

[87] PCT Pub. No.: WO97/05226

PCT Pub. Date: Feb. 13, 1997

[30] Foreign Application Priority Data

Jul. 25, 1995 [GB] United Kingdom ..... 9515211

[51] Int. Cl.[7] ..... C11D 7/36; C11D 7/12; C11D 7/14

[52] U.S. Cl. ..... 510/224; 510/228; 510/230; 510/298; 510/349; 510/361; 510/441; 510/446; 510/469; 510/475; 510/509; 510/511

[58] Field of Search ..... 510/224, 225, 510/228, 298, 349, 439, 441, 446, 467, 475, 509, 511, 230, 361, 469

[56] References Cited

U.S. PATENT DOCUMENTS

| | | | |
|---|---|---|---|
| 3,609,075 | 9/1971 | Barbera | 510/469 |
| 4,291,071 | 9/1981 | Harris et al. | 510/305 |
| 4,545,784 | 10/1985 | Sanderson | 510/312 |
| 4,756,849 | 7/1988 | Weber et al. | 510/305 |
| 4,919,845 | 4/1990 | Vogt et al. | 510/356 |
| 4,921,613 | 5/1990 | Gradwell et al. | 252/186.38 |
| 4,921,631 | 5/1990 | Gradwell et al. | 252/186.38 |
| 5,382,377 | 1/1995 | Raehse et al. | 510/445 |
| 5,409,805 | 4/1995 | Haraguchi et al. | 430/449 |
| 5,411,673 | 5/1995 | Agar et al. | 510/312 |
| 5,433,881 | 7/1995 | Townend et al. | 510/313 |
| 5,587,277 | 12/1996 | Yamashita et al. | 430/458 |
| 5,710,115 | 1/1998 | Patel et al. | 510/224 |
| 5,801,137 | 9/1998 | Addison et al. | 510/228 |

FOREIGN PATENT DOCUMENTS

93/00419 1/1993 WIPO .

*Primary Examiner*—Caroline D. Liott
*Attorney, Agent, or Firm*—David M. Goodrich; Kim William Zerby; Jacobus C. Rasser

[57] ABSTRACT

This is provided a detergent composition in compacted solid form containing (a) an organo diphosphonate crystal growth inhibitor; and (b) an alkalinity system comprising alkaline salts selected from the group consisting of alkali and alkaline earth carbonates, bicarbonates, hydroxides and silicates wherein at least part of the alkalinity system comprises particulate alkaline salts coated with an organic binder and the weight ratio of organic binder to alkalinity system in the detergent composition is from 1:100 to 1:1. A making process is also provided.

10 Claims, No Drawings

DETERGENT COMPOSITIONS IN COMPACTED SOLID FORM

FIELD OF THE INVENTION

The present invention relates to detergent compositions in compacted solid form containing an alkalinity system and a crystal growth inhibitor.

BACKGROUND OF THE INVENTION

Detergent compositions for use in automatic dishwashing or laundry machines are often in granular or powder form. Such compositions are measured and dosed by the consumer and placed in the dispenser of the machine which is located in the door in the case of dishwashing machines or the dispensing tray of an automatic laundry washing machine.

In order to simplify the dosing of detergents for automatic washing machines however, many of the automatic washing detergent compositions are now provided in compacted solid forms, such as bars, tablets or briquettes. This provides a number of advantages to both the consumer and manufacturer. Firstly, such compacted forms allow for easier handling of the detergent composition. Secondly, the compacted solids are generally sized to meet dosage requirements. Thirdly, the use of compacted solid forms minimizes the contact by the consumer with the composition.

It is highly desirable that the compacted solid forms possess a certain degree of hardness and strength. In particular they should be sufficiently hard to meet safety requirements. Detergent compositions are typically highly alkaline and thus oral consumption must be avoided. However, compacted solid forms, particularly tablets often appear attractive to children, who may attempt to consume them. Furthermore, it is also desirable that the compacted solids should be strong enough that they are not susceptible to damage upon packing, transport or storage.

Compacted form detergent compositions for use in laundry and machine dishwashing methods typically contain, for cleaning effectiveness, an alkalinity system. Silicate is an especially common component of such alkalinity systems. In addition to providing cleaning performance, silicate salts have the ability to enhance the hardness and strength of the compacted form products. It is believed that such ability is due to its tendency to form strengthening water bridges between silicate particles. However, it has been established that to achieve the effective formation of the silicate-water bridges, a high proportion of water must be present in the product matrix, which can be undesirable from a product stability standpoint, particularly if the matrix contains components, which are susceptible to hydrolytic degradation on storage (e.g. bleach components).

It has also, been established that the presence of high levels of silicate (typically>12% by weight $SiO_2$) can potentially lead to problems with the corrosion of glassware in the machine dishwashing load. In view of both product stability and glasscare considerations it is thus preferable to keep the amount of silicate salts below a certain level. It is also however, necessary to maintain a high alkalinity to achieve satisfactory cleaning performance. Partial or full replacement of silicate salts by carbonate salts addresses each of these performance requirements.

The presence of carbonate salts can however give rise to a problem with the formation of white deposits, as spots and films, on the articles in the machine dishwashing load. The strength and hardness of the compacted product can also be reduced when silicate salts are replaced by carbonate salts in a composition.

The Applicant has now found that the white deposits problem can be ameliorated by inclusion of a crystal growth inhibitor compound into the detergent composition. The Application has also found that the strength and hardness of the product, and its capacity to retain the desired physical structure on aging may be increased if at least part of the alkalinity system is made up of particles coated at certain levels with an organic binder material, particularly a polyethylene glycol material. The use of such an organic binder also aids product disintegrability in the wash which assists cleaning performance. Thus, in accord with the invention a product having cleaning effectiveness, minimized tendency to form white deposits, and which has suitably hard and strong compacted form may be obtained at low pressures.

BACKGROUND ART

EP-A-522,766, discloses at Example 2 a tabletted detergent composition formed from a base powder containing 4% sodium silicate, 14.3% sodium carbonate and other detergent ingredients. The base powder is sprayed with PEG 1500 at a coating level of 3% prior to tablet compaction. The composition contains no crystal growth inhibitor component.

EP-A-466,484 describes tabletted detergent compositions. Polyethylene glycol is described as a preferred binder/disintegrant. Crystal growth inhibitor components are not described.

EP-A-628,627 describes a tablet containing polyethylene glycols of molecular weight from 1000 to 6000 as tabletting auxilliaries. Crystal growth inhibitor components are not described.

WO 93/00419 describes carbonate-containing detergent tablet formulations which include HEDP as a preferred component. Low foaming surfactants, including preferably $C_{12}$–$C_{18}$ alkylpolyethylene glycol-polypropylene glycol ethers with up to 8 moles of ethylene oxide and propylene oxide units in the molecule are described as preferred auxilliary ingredients. Organic binder components are not specifically described.

GB-A-2285052 describes at Example 3, a formulation containing 14% sodium carbonate and 0.6% HEDP, but no organic binder component.

None of the identified prior art documents provide specific disclosure of a compacted solid form detergent product containing a crystal growth inhibitor and an alkalinity system wherein at least part of the alkalinity system comprises particulate alkaline salts coated with an organic binder.

Furthermore, none of these documents address the problem of providing a suitably heard and strong compacted form alkaline detergent composition having good cleaning performance, and having a reduced tendency to form white deposits on the articles in a machine dishwashing load. Nor do any of them describe the solution as provided by the present invention.

SUMMARY OF THE INVENTION

According to the present invention there is provided a detergent composition in compacted solid form containing (a) an organo diphosphonate crystal growth inhibitor; and (b) an alkalinity system comprising alkaline salts selected from the group consisting of alkali and alkaline earth carbonates, bicarbonates, hydroxides and silicates.

wherein at least part of the alkalinity system comprises particulate alkaline salts coated with an organic binder and the weight ratio of organic binder to alkalinity system in the detergent composition is from 1:100 to 1:1.

All amounts, weights, ratios and percentages are as a % weight of the detergent composition unless otherwise stated.

All documents cited in the present description are, in relevant part, incorporated herein by reference.

DETAILED DESCRIPTION OF THE INVENTION

In an essential aspect the detergent composition is in solid compacted form. As used herein the term solid compacted form refers to a solid product form obtained by compaction or compression, typically of a particulate or pasty composition. By pasty composition it is meant therein a paste-like composition, of typically relatively high viscosity, comprising particulates suspended or dispersed within a fluid mass. Suitable compacted solid forms include bars, briquettes, cakes or tablets.

Tablets, in accord with the invention, can be of essentially any suitable shape, but are designed to have the optimum weight/surface area ratio, and are preferably symmetrical to aid dissolution. Preferred tablet shapes include discs, especially those having a diameter of from 25 to 45 mm, and a thickness of from 10 to 20 mm.

Crystal Growth Inhibitor

An essential component of the detergent compositions in accordance with the invention is an organo diphosphonate, that is an organo diphosphonic acid or one of its salts/complexes. Preferably any salts/complexes are water soluble, with the alkali metal and alkaline earth metal salts/complexes being especially preferred.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrants.

The organo diphosphonate component is preferably present at a level of from 0.005% to 20%, more preferably from 0.1% to 10%, most preferably from 0.2% to 5% by weight of the detergent compositions.

The organo diphosphonate is preferably derived from a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP). Also suitable are alpha hydroxy-2 phenyl ethyl diphosphonate, methylidene diphosphonate, hydroxy 1,1-hexylidene and vinylidene 1,1 diphosphonate.

Alkalinity System

In an essential aspect the compositions contain an alkalinity system comprising components capable of providing alkalinity species in solution. By alkalinity species it is meant for the purposes of this invention: carbonate, bicarbonate, hydroxide and the various silicate anions. Such alkalinity species can be formed for example, when alkaline salts selected from alkali metal or alkaline earth carbonate, bicarbonate, hydroxide or silicate, including crystalline layered silicate, salts and any mixtures thereof are dissolved in water. Alkali metal percarbonate and persilicate salts are also suitable sources of alkalinity species.

The alkalinity system is preferably present at a level of from 1.5% to 95%, preferably from 5% to 60%, most preferably from 10% to 40% by weight of the detergent composition.

To enable practical comparison of the relative capacity of compositions containing different alkaline components to deliver alkalinity to a wash solution it is useful to express the alkalinity released on addition of the compositions to the wash solution in terms of % weight equivalent of NaOH. That is, in terms of the % weight of NaOH which would have equivalent 'alkaline effect', e.g. in neutralising acid species, to that of the alkalinity species actually released when the composition is added to the wash. For uniform comparison it is also then useful to define standard wash solution characteristics. Thus, the capacity to deliver alkalinity to a wash solution is herein characterized by reference to a representative test method now described.

Alkalinity Release Test Method

A 1 g sample of detergent composition is added to 100 ml of distilled water at a temperature of 30° C. with stirring at 150 rpm using a magnetic stirrer of size 2 cm, thus providing a 1% detergent solution, as would be a typical concentration of a laundry wash solution. The solution is titrated against a standard HCl solution using any suitable titration method. Commonly known acid-base titration methods employing colorimetric end-point determination methods, for example using chemical end-point indicators are particularly suitable. Thus, the number of moles of HCl which the detergent solution is capable of neutralising is obtained. For the avoidance of doubt, 'neutralising' in this context is defined to mean titrating to pH 7. This number will be equivalent to the number of moles of alkalinity, expressed as NaOH equivalent, present in the detergent solution. Thus, the % weight equivalent NaOH present in the sample of the detergent composition may be calculated as:

% weight equivalent NaOH=100×number of moles NaOH equivalent in solution×Mw of NaOH Alkalinity Delivery Capacity In a preferred aspect, the alkalinity system is present in the detergent composition such that the capacity to deliver alkalinity to a wash solution measured by the given test method is such that the weight NaOH equivalent of the composition is greater than 3%, preferably greater than 5%, most preferably greater than 8% by weight of the composition.

Alkaline Components

Examples of carbonates are the alkaline earth and alkali metal carbonates, including sodium carbonate and any mixtures thereof with ultra-fine calcium carbonate such as are disclosed in German Patent Application No. 2,321,001 published on Nov. 15, 1973. Alkali metal percarbonate salts are also suitable sources of carbonate species and are described in more detail in the section 'inorganic perhydrate salts' herein.

Suitable silicates include the water soluble sodium silicates with an $SiO_2$: $Na_2O$ ratio of from 1.0 to 2.8, with ratios of from 1.6 to 2.0 being preferred, and 2.0 ratio being most preferred. The silicates may be in the form of either the anhydrous salt or a hydrated salt. Sodium silicate with an $SiO_2$: $Na_2O$ ratio of 2.0 is the most preferred silicate. Alkali metal persilicates are also suitable sources of silicate herein.

Preferred crystalline layered silicates for use herein have the general formula:

$$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. Herein, x in the general formula above preferably has a value of 2, 3 or 4 and is preferably 2. The most preferred material is $\delta$-$Na_2Si_2O_5$, available from Hoechst AG as NaSKS-6.

The crystalline layered silicate material is preferably present in granular detergent compositions as a particulate in intimate admixture with a solid, water-soluble ionisable material. The solid, water-soluble ionisable material is selected from organic acids, organic and inorganic acid salts and mixtures thereof.

Silicate salts are preferably present in an amount of less than 12%, preferably less than 10%, most preferably less than 9% active silicate (i.e. $SiO_2$) by weight of the detergent composition.

In a highly preferred aspect, the alkalinity system consists of both carbonate and silicate salts to provide a weight ratio of active carbonate (i.e. $CO_3^{2-}$) to active silicate (i.e. $SiO_2$) of from 1:4 to 4:1, more preferably 1:3 to 3:1, most preferably from 1:2 to 2:1.

Coating of Alkaline Components

The alkalinity system comprises at least in part, particulate alkaline salts coated with an organic binder. The weight ratio of organic binder to alkalinity system in the detergent composition is from 1:100 to 1:1, preferably from 1:40 to 1:3, most preferably from 1:20 to 1:5, the most preferred range being preferred from a tablet hardness standpoint.

Organic Binder

The overall level of organic binder in the detergent composition should not exceed 20%, and is preferably less than 10%.

Especially preferred organic binders herein are the polyethylene glycols (PEG) with an average average molecular weight of from 600 to 10,000, preferably from 1,000 to 8,000, more preferably from 1200 to 5,000, most preferably 1,500 (i.e. PEG 1500).

Further examples of suitable organic binders include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Preferred examples of such compounds are the polymers which contain acrylic acid, that is to say homopolymers of acrylic acid and copolymers with any suitable other monomer units, and which have a average molecular weight of from 2,000 to 100,000. Suitable other monomer units include modified acrylic, fumaric, maleic, itaconic, aconitic, mesaconic, citraconic and methylenemalonic acid or their salts, maleic anhydride, acrylamide, alkylene, vinylmethyl ether, sytrene and any mixtures thereof. Preferred are the copolymers of acrylic acid and maleic anhydride having a average molecular weight of from 20,000 to 100,000.

Preferred acrylic acid containing polymers have an average molecular weight of less than 15,000, and include those sold under the tradename Sokalan PA30, PA20, PA15, PA10 and Sokalan CP10 by BASF GmbH, and those sold under the tradename Acusol 45N by Rohm and Haas.

Other preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula —[$CR_2$—$CR_1$(CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a average molecular weight of from 4500 to 3000 and contains 60% to 80% by weight of acrylic acid and 40% to 20% by weight of methacrylic acid.

The polyamino compounds are useful as organic binders herein including those derived from aspartic acid such as those disclosed in EP-A-305282, EP-A-305283 and EP-A-351629.

Other suitable binders include $C_{10}$–$C_{20}$ alcohol ethoxylates containing from 5–100 moles of ethylene oxide per mole of alcohol and more preferably the $C_{15}$–$C_{20}$ primary alcohol ethoxylates containing from 20–100 moles of ethylene oxide per mole of alcohol.

Polyvinylpyrrolidones with an average molecular weight of from 12,000 to 700,000 are suitable polymeric binders herein. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binders include the $C_{10}$–$C_{20}$ mono- and diglycerol ethers and also the $C_{10}$–$C_{20}$ fatty acids.

Additional Detergent Ingredients

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Water-Soluble Builder Compound

The compositions of the present invention may contain as a highly preferred component a water-soluble builder compound, typically present at a level of from 1% to 80% by weight, preferably from 10% to 70% by weight, most preferably from 20% to 60% by weight of the detergent composition.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, phosphates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicylic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that 50° C., especially less than 40° C.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Partially Soluble or Insoluble Builder Compound

The compositions of the present invention may less preferably contain a plurality soluble or insoluble builder compound. Examples of largely water insoluble builders include the sodium aluminosilicates, including Zeolite A, Zeolite B, Zeolite P, Zeolite X, Zeolite MAP, Zeolite HS and mixtures thereof.

Surfactant

A highly preferred component of the compositions of the invention is a surfactant system comprising surfactant selected from anionic, cationic, nonionic ampholytic and zwitterionic surfactants and mixtures thereof. Preferably the surfactant system comprises low foaming surfactant, which is typically nonionic in character. The surfactant system is typically present at a level of from 0.2% to 30% by weight, more preferably from 0.5% to 10% by weight, most preferably from 1% to 5% by weight of the compositions.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981. A listing of surfactants typically included in automatic dishwashing detergent compositions is given for example, in EP-A-0414 549 and PCT Applications No.s WO 93/08876 and WO 93/08874.

Nonionic Surfactant

Essentially any nonionic surfactants useful for detersive purposes can be included in the compositions. Preferred, non-limiting classes of useful nonionic surfactants are listed below.

Nonionic Ethoxylated Alcohol Surfactant

The alkyl ethoxylate condensation products of aliphatic alcohols with from 1 to 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Ethoxylated/Propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from 1500 to 1800 and exhibits water insolubility. Examples of compounds of this type include certain of the commercially-available Pluronic™ surfactants, marketed by BASF.

Nonionic EO Condensation Products with Propylene Oxide/Ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from 2500 to 3000. Examples of this type of nonionic surfactant include certain of the commercially available Tetronic™ compounds, marketed by BASF.

Organic Polymeric Compound

Organic polymeric compounds may be added as preferred separate components of the compositions in accord with the invention. In addition such organic polymeric compounds may find use as organic binders in accord with the invention as described hereinbefore. By organic polymeric compound it is meant essentially any polymeric organic compound commonly used as dispersants, and anti-redeposition and soil suspension agents in detergent compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of average molecular weight 2000–10000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a average molecular weight of from 20,000 to 100,000.

Preferred commercially available acrylic acid containing polymers having a average molecular weight below 15,000 include those sold under the tradename Sokalan PA30, PA20, PA15, PA10 and Sokalan CP10 by BASF GmbH, and those sold under the tradename Acusol 45N by Rohm and Haas.

Preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula —[$CR_2$—$CR_1$(CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a average molecular weight of 3500 and contains 60% to 80% by weight of acrylic acid and 40% to 20% by weight of methacrylic acid.

The polyamino compounds are useful herein including those derived from aspartic acid such as those disclosed in EP-A-305282, EP-A-305283 and EP-A-351629.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylene diaminetriacetates, nitrilotriacetates, ethylenediamine tetraproprionates, triethylenetetraamine- hexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) as DEQUEST. Preferred, these amino phosphonates to not contain alkyl or alkenyl groups with more than 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilised, these chelating agents will generally comprise from 0.1% to 10%, preferably from 0.1% to 3.0% by weight of the detergent compositions herein.

Enzymes

Enzymes can be included in the formulations herein for a wide variety of stain/soil removal purposes, including removal of protein-based, carbohydrate-based, or triglyceride-based stains. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at level sufficient to provide up to 5 mg by weight, more typically 0.01 mg to 3 mg, of active enzyme per gram of the composition. State otherwise, the compositions herein will typically comprise from 0.001% to 10%, preferably 0.01% to 5% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis and B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo CO., Tagata, Japan; and further *Chromobacter viscosum* lipases from U.S. Biochemical Corp., U.S.A. and Disoynth Co., The Netherlands, and lipases ex *Pseudomanas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Enzyme Stabilizers

The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706.

Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from 0.1% to 30%, more typically from 1% to 20%, of the detergent composition, especially for fabric laundering. If present, the amount of bleach activators will typically be from 0.1% to 60%, more typically from 0.5% to 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

Mixtures of bleaching agents can also be used. Peroxygen bleaching agents, the perborates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 5,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from 6 to 12 carbon atoms, $R^2$ is an alkylene containing from 1 to 6 carbon atoms, $R^5$ is H or alkyl, aryl, or alkaryl containing from 1 to 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

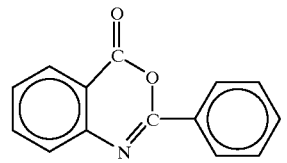

Still another class of preferred bleach activators includes the acyl lactam activators, especially acyl caprolactams and acyl valerolactams of the formulae:

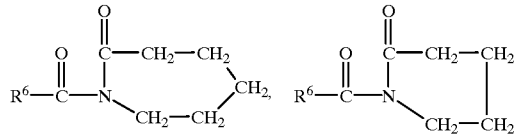

wherein $R^6$ is H or an alkyl, aryl, alkoxyaryl, or alkaryl group containing from 1 to 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilised herein. One type of non-oxygen bleaching agent of particular interest includes photoactivated bleaching agents such as the sulfonated zinc and/or aluminium phthalocyanines. See U.S. Pat. No. 4,033,718, issued Jul. 5, 1977 to Holcombe et al. If used, detergent compositions will typically contain from 0.025% to 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}{}_2(u\text{-}O)_3(1,4,7\text{-trimethyl-}1,4,7\text{-triazacyclononane})_2(PF_6)_2$, $Mn^{III}{}_2(u\text{-}O)_1(u\text{-}OAc)_2(1,4,7\text{-trimethyl-}1,4,7\text{-triazacyclononane})_2\text{-}(ClO_4)_2$, $Mn^{IV}{}_4(u\text{-}O)_6(1,4,7\text{-triazacyclononane})_4(ClO_4)_4$, $Mn^{III}Mn^{IV}{}_4\text{-}(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; 5,227,084;

Corrosion Inhibitor Compound

The compositions may contain corrosion inhibitors preferably selected from organic silver coating agents, particularly paraffin, nitrogen-containing corrosion inhibitor compounds, bismuth compounds and Mn(II) compounds, particularly Mn(II) salts of organic ligands.

Organic silver coating agents are described in PCT Publication No. WO94/16047 and copending UK Application No. UK 9413729.6 (attorney's docket no. CM750F). Nitrogen-containing corrosion inhibitor compounds are disclosed in copending European Application no. EP 93202095.1 (attorney's docket no. CM571F). Mn(II) compounds for use in corrosion inhibition are described in copending UK Application No. 9418567.5 (attorney's docket no. CM719FM).

Other Ingredients

A wide variety of other ingredients useful in detergent compositions can be included in the compositions herein, including other active ingredients, carriers, hydrotropes, processing aids, dyes or pigments, etc. Ingredients may also be incorporated to assist in the tabletting process such as lubricating agents, sodium acetate and nonionic surfactants.

Compact Solid Preparation

Another aspect of the present invention relates to the preparation of the compacted solid detergent compositions. The compacted solids may be manufactured using any suitable compacting process, such as tabletting, briquetting or extrusion, preferably tabletting. Preferably tablets are manufactured using a standard rotary tabletting press using compression forces of from 5 to 13 $KN/cm^2$, more preferably from 5 to 11 $KN/cm^2$.

A preferred process for making the detergent compositions of the invention includes the step of spraying of the organic binder material onto at least a portion of the alkalinity system.

According to a preferred process aspect of the present invention the compacted solids are prepared by the following process.

1. Organic binder material is sprayed onto at least a portion of the alkalinity system which comprises particles of suitable alkaline salts, particularly silicate salts, until a suitable coating level is achieved.

2. The resulting coated alkalinity system is dry added to other ingredients particularly any builder salts, in a tumbling mixer.

3. The organo diphosphonate crystal growth inhibitor and optionally other ingredients such as nonionic surfactants, chelants and silvercare additives are sprayed on to the mixture.

4. The resultant mixture is passed through a second mixer for a short final mixing period.

5. Compaction of the mixture.

A time interval may be left between completion of step 1 and commencement of step 2.

In an alternative aspect to the process the organo diphosphonate crystal growth inhibitor is dry added in step 2, as an agglomerate particle.

According to another preferred process aspect of the present invention the compacted solids are prepared by the following process.

1. The alkalinity system which comprises particles of suitable alkaline salts, particularly silicate salts, and optionally other ingredients particularly any builder salts, are dry mixed in a tumbling mixer.

2. The organo diphosphonate crystal growth inhibitor, the organic binder and optionally other ingredients such as nonionic surfactants, chelants and silvercare additives are sprayed on to the mixture.

3. The resultant mixture is passed through a second mixer for a short final mixing period.

4. Compaction of the mixture.

In an alternative aspect to the process the organo diphosphonate crystal growth inhibitor is dry mixed in step 1, as an agglomerate particle.

The compaction step is achieved by conventional means, for example on a 12 head rotary press under a compression force of 5–13 $KN/cm^2$ so that the compacted solid has a minimum hardness of 176N to 245N, preferably from 195N to 275N, measured by a C100 hardness test as supplied by I. Holland Instruments. This process may be used to prepare homogenous or layered compacted forms, particularly tablets of any size or shape. Preferably, tablets are symmetrical to ensure the uniform dissolution of the tablet in the wash liquor.

According to the present invention the compacted form detergent compositions may find utility in all types of automatic dish- and laundry washing machines including industrial and domestic machines.

Abbreviations Used in Examples

In the detergent compositions, the abbreviated component identifications have the following meanings:

| | | |
|---|---|---|
| Nonionic | : | A mixture of $C_{13-15}$ predominantly linear primary alcohols condensed with an average of 2 moles of propylene oxide and 6 moles of ethylene oxide |
| Silicate | : | Granular sodium silicate ($SiO_2$:$Na_2O$ ratio = 2.0) |
| PEG | : | Polyethylene glycol with an average molecular weight of 1500 (i.e. PEG 1500) |
| Sulphate | : | Anhydrous sodium sulphate |
| Polymer/HEDP/ Sulphate agglomerate | : | Agglomerate particle containing at a weight ratio of 6:1:18, a random copolymer of 3:7 acrylic/methacrylic acid (Mw = 3,500); HEDP; and sodium sulphate. |
| Citrate | : | Tri-sodium citrate dihydrate |
| DETPMP | : | Diethylene triamine penta (Methylene phosphonic acid), marketed by Monsanto under the Tradename Dequest 2060 |
| TAED | : | Tetraacetyl ethylene diamine |
| PB1 | : | Anhydrous sodium perborate monohydrate bleach |
| Silvercare additive | : | 1:2 mixture of benzotriazole and a paraffin oil sold under the tradename Winog 70 by Wintershall |

EXAMPLE

The following tabletted detergent compositions A to B suitable for use in an automatic dishwashing machine were prepared by the following process in accord with the invention:

1. PEG 1500 was sprayed onto the granular silicate until a suitable coating level was achieved, optimally providing a weight ratio of granular silicate to PEG 1500 of from 10:1 to 3:1.

2. The resulting coated silicate particles were dry added to all of the other ingredients, including HEDP containing agglomerate particles, except those added in the spray on step 3, in a tumbling mixer.

3. The nonionic surfactant, DETPMP and silvercare additive ingredients were sprayed on to the dry mix.

4. The resultant mixture was passed through a second mixer for a short final mixing period.

5. The mixture was then compacted using a 12 head rotary press under a compression force of 5–13 $KN/cm^2$ so that the compacted solid products had a minimum hardness of 195N, measured by a C100 hardness test as supplied by I. Holland Instruments.

The tablets so formed were disc shaped having a diameter of 38 mm and thickness of 14 mm.

The reference product, denoted 'Ref', was prepared by an identical process, other than that the initial silicate coating step was absent, and thus the uncoated silicate was simply dry added as in step 2. of the process for compositions A to C.

The tabletted composition C was preferred by an identical process other than that the HEDP was added as a spray on in step 3., rather than as a component of an agglomerate particle.

| Tablet | Ref | A | B | C |
|---|---|---|---|---|
| Citrate | 13.6 | 13.6 | 17.1 | 26.4 |
| Carbonate | 14.0 | 14.0 | 17.5 | 15.0 |
| Silicate | 10.5 | 10.9 | 13.6 | 11.8 |
| PEG | — | 2.0 | 2.0 | 1.5 |
| Metasilicate | 2.0 | 2.0 | 2.5 | — |

-continued

| Tablet | Ref | A | B | C |
|---|---|---|---|---|
| Polymer/HEDP/ sulphate agglomerate | 21.0 | 21.0 | 26.3 | — |
| HEDP (sprayed on) | — | — | — | 0.7 |
| PB1 | 7.8 | 7.8 | 9.7 | 1.5 |
| PB4 | — | — | — | 6.9 |
| TAED | 2.2 | 2.2 | 2.7 | 4.3 |
| Enzymes | 1.8 | 1.8 | 2.2 | 3.0 |
| Silvercare additive | 0.64 | 0.64 | 0.8 | 0.6 |
| Nonionic | 1.6 | 1.6 | 2.0 | 1.2 |
| Sulphate | 19.7 | 19.7 | — | 18.1 |
| Misc/balance to 100% | | | | |

Product Hardness

The hardness (expressed in units of Kg) of the reference product was compared to that of Composition A after first manufacture and after storage at 40° C.

| | Ref | A |
|---|---|---|
| Freshly made | 25.4 | 37.2 |
| 1 week storage | 25.1 | 48.6 |
| 2 weeks storage | 26.2 | 45.2 |

What is claimed is:

1. A detergent composition in compacted solid form containing:

(a) an organo diphosphonate crystal growth inhibitor; and (b) an alkalinity system comprising particulate alkaline salts, wherein the alkaline salts include carbonate salts and silicate salts present in a weight ratio of active carbonate to active silicate of from 1:4 to 4:1 and the detergent compositions comprises less than 12%, by weight, of active silicates;

wherein at least a portion of the particulate alkaline salts are coated with an organic binder and the weight ratio of organic binder to the particulate alkaline salts in the detergent composition is from 1:100 to 1:1.

2. A detergent composition according to claim 1 wherein the organo diphosphonate component is present at a level of from 0.005% to 20% by weight of the detergent composition.

3. A detergent composition according to claim 1 wherein the organo diphosphonate is ethane 1-hydroxy-1,1-diphosphonate (HEDP).

4. A detergent composition according to claim 1 wherein the alkalinity system is present at a level of from 1.5% to 95% by weight of the detergent composition.

5. A detergent composition according to claim 1 wherein said organic binder is a polyethylene glycol (PEG) with an average molecular weight of from 600 to 10,000.

6. A detergent composition according to claim 1 wherein the weight ratio of organic binder to the particulate alkaline salts in the detergent composition is from 1:20 to 1:3.

7. A detergent composition according to claim 1 in tablet form.

8. A process for making a detergent composition according to claim 1 including the step of spraying of the organic binder material onto at least a portion of the alkalinity system.

9. A detergent composition according to claim 5 wherein said organic binder is a polyethylene glycol (PEG) with an average molecular weight of from 1,000 to 8,000.

10. A detergent composition according to claim 1 wherein the organic binder is selected from the group consisting of polyethylene glycols with an average molecular weight of from 600 to 10,000, water soluble organic homopolymeric or copolymeric polycarboxylic acids or the salts thereof in which the polycarboxylic acid comprises at least two carboxyl radicals separated from each other by not more than two carbon atoms, polyvinylpyrrolidones with an average molecular weight of from 12,000 to 700,000 and mixtures thereof.

* * * * *